US006482099B1

(12) United States Patent
Schaum

(10) Patent No.: US 6,482,099 B1
(45) **Date of Patent: *Nov. 19, 2002**

(54) GOLF TRAINING DEVICE

(76) Inventor: Eduard Carl Schaum, P.O. Box 5264, Newport Beach, CA (US) 92662

( * ) Notice: Subject to any disclaimer, the term of this patent is extended or adjusted under 35 U.S.C. 154(b) by 0 days.

This patent is subject to a terminal disclaimer.

(21) Appl. No.: 09/266,980

(22) Filed: Mar. 12, 1999

Related U.S. Application Data

(62) Division of application No. 08/961,042, filed on Oct. 30, 1997, now Pat. No. 5,882,266.

(51) Int. Cl.[7] ..... A63B 69/36
(52) U.S. Cl. ..... 473/220; 473/240
(58) Field of Search ..... 473/240, 220, 473/237

(56) References Cited

U.S. PATENT DOCUMENTS

| | | | | | |
|---|---|---|---|---|---|
| 3,507,500 | A | | 4/1970 | Scott | 273/186 |
| 3,953,034 | A | * | 4/1976 | Nelson | 473/220 |
| 5,207,429 | A | * | 5/1993 | Walmsley et al. | 473/220 |
| 5,467,991 | A | * | 11/1995 | White, IV et al. | 473/220 |
| 5,692,965 | A | * | 12/1997 | Nigham, Jr. et al. | 473/220 |
| 5,725,440 | A | | 3/1998 | Finney | 473/220 |
| 5,788,588 | A | | 8/1998 | Hooker | 473/409 |
| 5,860,871 | A | * | 1/1999 | Marley, Jr. | 473/220 |
| 5,882,266 | A | * | 3/1999 | Schaum | 473/220 |
| 5,954,592 | A | * | 9/1999 | Laffer et al. | 473/220 |
| 5,993,333 | A | * | 11/1999 | Heckaman | 473/220 |

* cited by examiner

*Primary Examiner*—Mark S. Graham
*Assistant Examiner*—Raeann Gorden
(74) *Attorney, Agent, or Firm*—Stout, Uxa, Buyan & Mullins, LLP; Frank J. Uxa

(57) ABSTRACT

A golf training device which clamps onto the shaft of a standard golf club. The device has a holding block which holds a laser pointing in a downward direction. A hinged mirror at the light emitting end of the laser causes the laser light to be reflected at roughly a ninety degree angle and thereby run parallel to the ground. An alignment strip and separate target helps the user calibrate the training device so that the laser beam is perpendicular to the flat head striking area of the golf club. The alignment strip can then be removed allowing the user to move the target to any reasonable distance. In this way a golfer can learn the proper alignment of club head to hole thereby improving his or her ability to accurately putt a golf ball towards and into the hole. The hinged mirror on the training device of the present invention can also be swung down so that the laser light is pointing straight down. In this orientation a user can swing a golf club in a practice room and observe the swing path of the club as the laser light forms a line as it strikes the floor, wall and ceiling. The training device of the present invention is easily attached and removed and is compact enough to be carried in ones pocket.

8 Claims, 4 Drawing Sheets

GOLF TRAINING DEVICE

RELATED APPLICATIONS

This is a division of application Ser. No. 08/961,042 filed Oct. 30, 1997, now U.S. Pat. No. 5,882,266 issued Mar. 16, 1999, disclosure of which is incorporated in its entirety herein by reference.

BACKGROUND OF THE INVENTION

The present invention relates to golf training devices and more specifically to a golf-training device, which removably attaches to a golf club and helps teach proper club alignment and resulting swing.

Many golf training devices are available in the market today. Golfers are always interested in improving their score. Since over forty percent of the strokes in a typical round of golf are made with the putter, it behooves the golfer to improve alignment and accuracy when putting the ball towards the hole. The present device provides a unique way to do just that.

OBJECTS AND SUMMARY OF THE PRESENT INVENTION

It is an object of the present invention to provide an improved golf training device to train a golfer to aim a golf ball more accurately toward the hole while putting. It is another object of the present invention to provide a golf training device which will also enable a golfer to visually check the path of swing of the club. It is a further object of the present invention to provide a golf training device which can be easily installed and removed from a golf club. Still a further object of the present invention to provide a golf training device which can be easily calibrated. A further object of the present invention is to provide a golf training device which is easy and economical to manufacture. The above objects are implemented by providing a holding block which can be fastened to a golf club without the use of special tools. The holding block holds a small helium neon laser which is in a parallel relationship to the shaft of the golf club. A mirror located below the light emitting end of the laser reflects the light at a ninety degree angle so the light is parallel to the ground. An alignment strip and target card enables the user to calibrate the laser so that the dot which the laser projects is at right angles to, and in alignment with the center flat hitting portion of the club head. The alignment strip can be removed and the user can then use the dot on the target card or a dot on any vertical surface such as a wall to act as an a target for the laser dot. The user can then grip the club and place the center of the striking surface a short distance behind the golf ball. By alternately removing and returning the club head to the hitting position several times, the user can feel and see the correct positioning of hands and club head for hitting the ball to a desired spot, in this case the spot on the target or the wall. The user can then actually hit the ball and see the ball hit the target After several practice sessions the user can achieve more accurate club headtarget alignment even after the training device has been removed from the club.

The mirror at the bottom of the laser is hinged and can be swung down and out of the way of the laser beam thereby causing the laser beam to point straight down. In this position a person can swing a club and see the line created by the moving dot projected by the laser beam as the laser light strikes the floor, walls and ceiling of the practice room. Of course the ceiling of the practice room must be sufficiently high to allow for a full swing.

GENERAL DESCRIPTION OF THE DRAWINGS

DETAILED DESCRIPTION OF THE DRAWINGS

Figure 1:
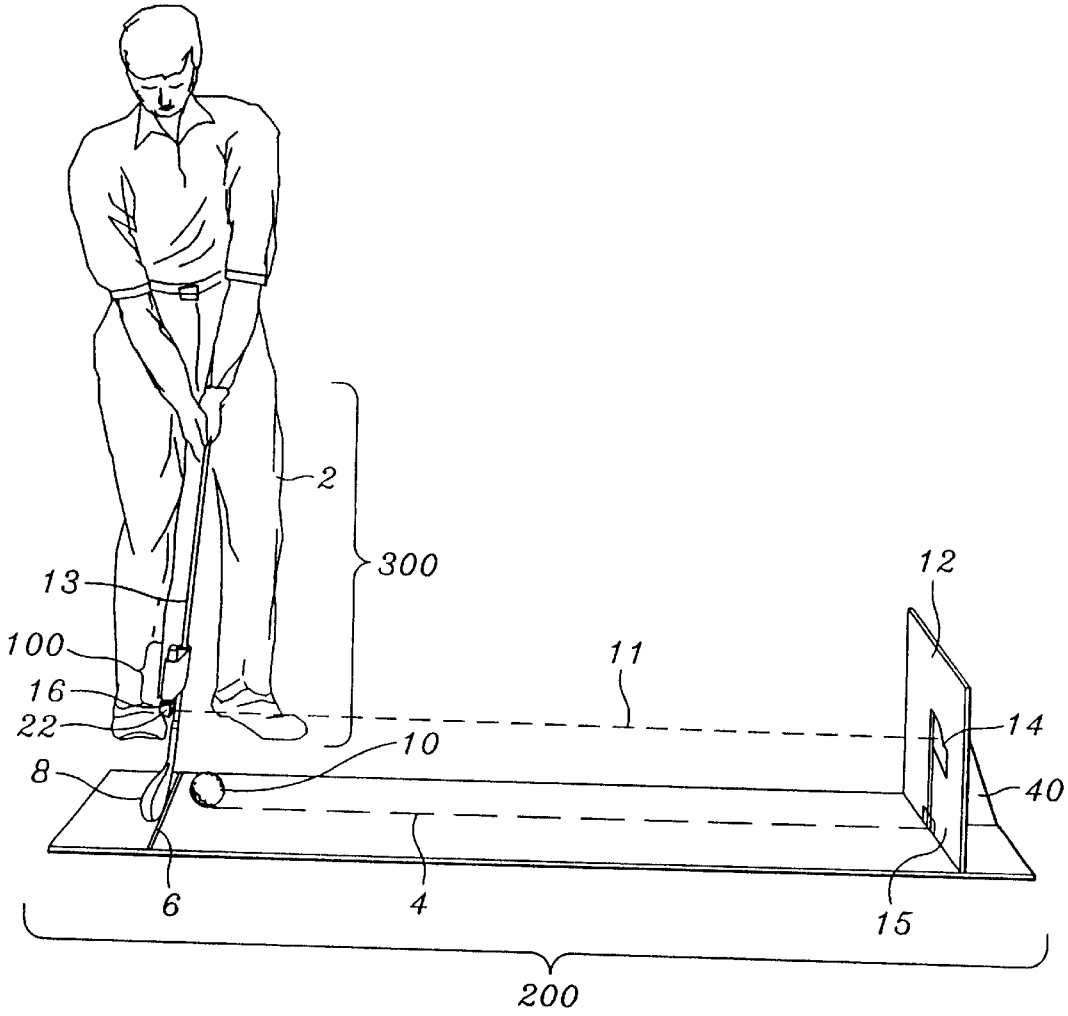
FIG. 1 is a perspective view of a golfer using the training device of the present invention.
Figure 2:
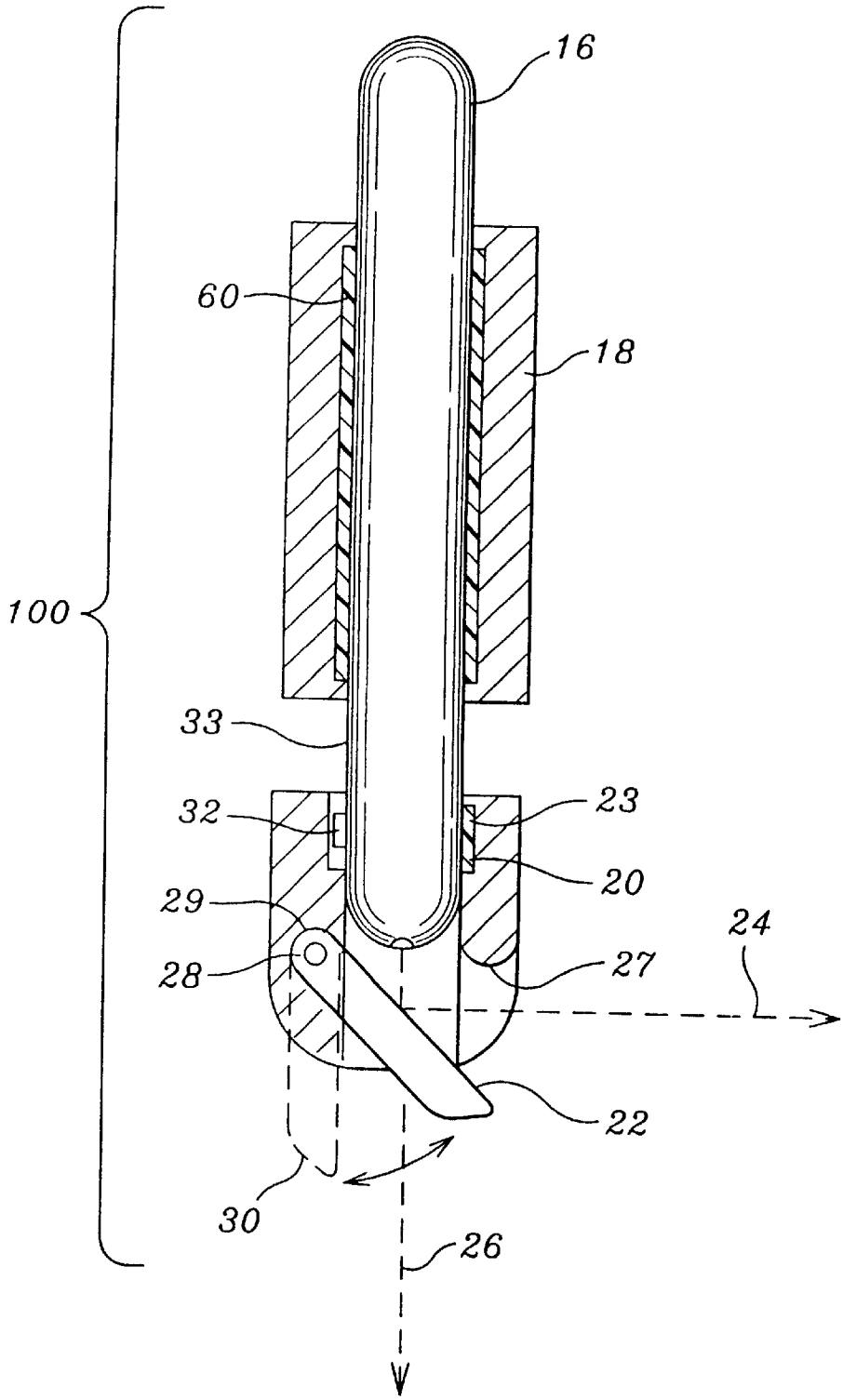
FIG. 2 is a side section view of the golf training device of the present invention.
Figure 3:
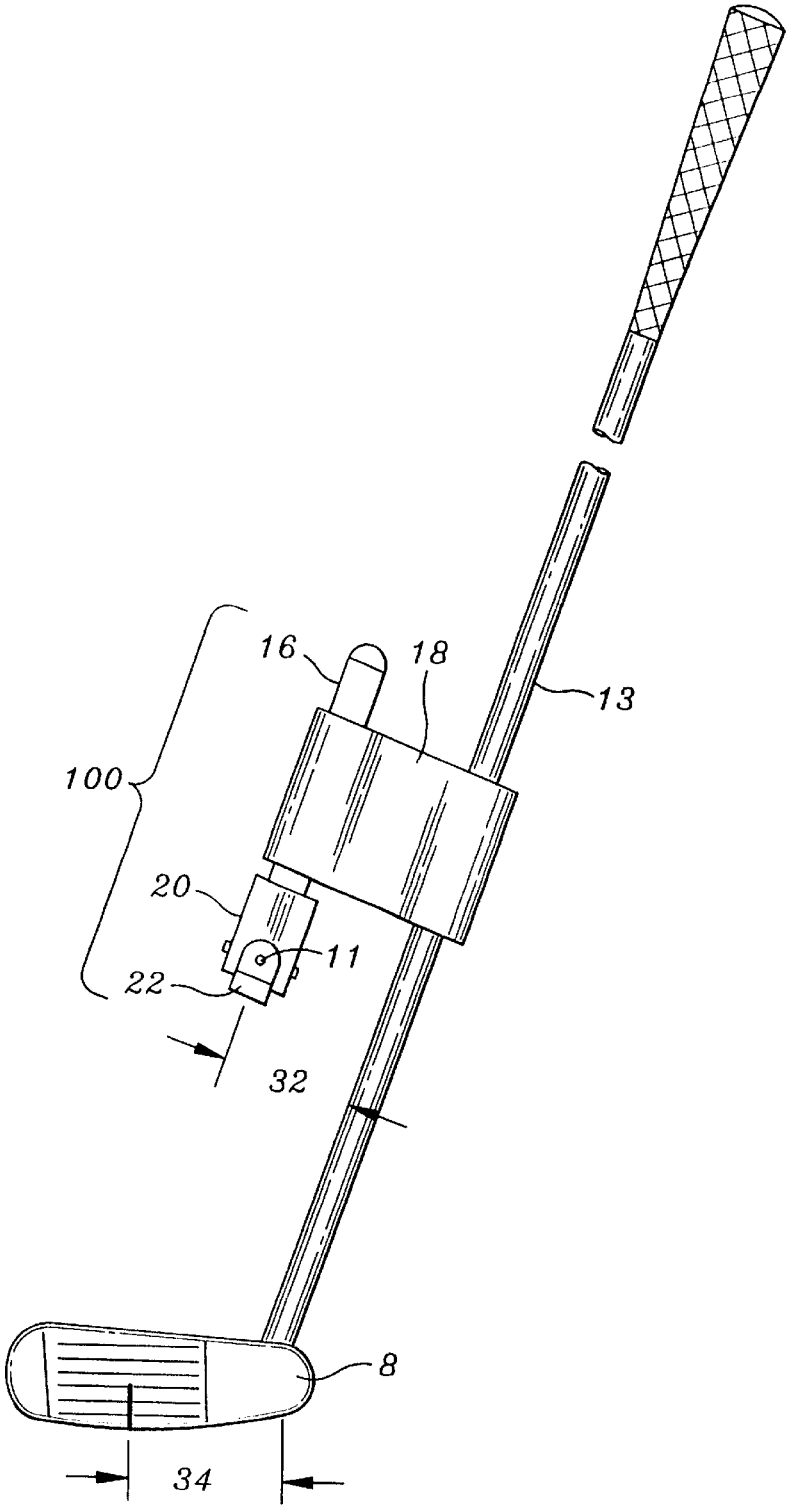
FIG. 3 is a side view of the present invention attached to a golf club.

Referring now to FIG. 1 we see a person 2 gripping a golf club 300. The golf training device of the present invention 100 is attached to the golf club 300. A laser 16 mounted in the training device 100 emits a downwardly pointing laser light which is then reflected by mirror 22 causing the laser light to go in a direction parallel to the ground 11. To calibrate the training device 100 the user places an alignment strip 200 on the ground. The strip 200 has a line 6 running parallel to the left short edge of the alignment strip 200 and a second line 4 running centrally down the length of the alignment strip and perpendicular to line 6. A target card 12 is placed on the alignment strip so that the vertical line 15 on the alignment card lines up with the central line 4 on the alignment strip. The user then rotates the training device 100 around the shaft 13 so that when the striking surface is placed on and parallel to line 6, the point where the laser light strikes the mirror 22 is directly above line 6. The user then rotates the collar 22 so that the reflected laser light strikes the spot 14 located at the center of the target card. At this point the training device 100 is calibrated. The user 2 can then remove the alignment strip 200 and simply aim the laser beam at the target card or at a spot on a wall or other vertical surface. The user can now feel and see the proper orientation of the golf club head as it relates to hitting a ball to a desired location. The user can actually hit a ball and see it land at the laser spot, assuming that the golf club head has not been twisted during the swing. FIG. 2 shows a section view of the golf training device of the present invention 100. Laser 16 is held by holding block 18. Laser 16 is similar to standard pointer type lasers that are used for pointing when giving office presentations or the like. Resilient strips 60 cause a frictional fit which allows the laser to be twisted and remains in place after adjustment. In the present embodiment, collar 20 is provided, which holds hinged mirror 22, as shown, and effectively secures the mirror 22 to the light source 16. Mirror 22 can be set at a forty five degree angle causing laser light 24 to progress in a horizontal direction. Resilient strip 23 causes a frictional fit which allows collar 22 to be twisted and to remain in place after adjustment. When mirror 22 is rotated downwardly as shown in dotted line 30 the laser beam progresses in a downward direction. In this mode the user can attach the training device 100 to a golf club and see a laser line as the club is swung in a practice room thereby allowing the user to observe the swing path of the club. Ramp 32 located inside collar 22 is aligned with an on-off button 33 on the laser. When collar 22 is raised it causes button to be depressed which turns on laser 16. When collar 22 is pulled down, button 33 is released causing laser 16 to turn off. Mirror 22 is a front surface mirror so that a double reflection of the laser light is avoided. Mirror 22 is stopped at the proper angle by ledge 27 on collar 20. Hinge pin 28 has a frictional fit with surrounding hinge enclosure 29 so that mirror 22 stays in place when moved from one position to the other. FIG. 3 shows a front view the golf-training device

Figure 4:
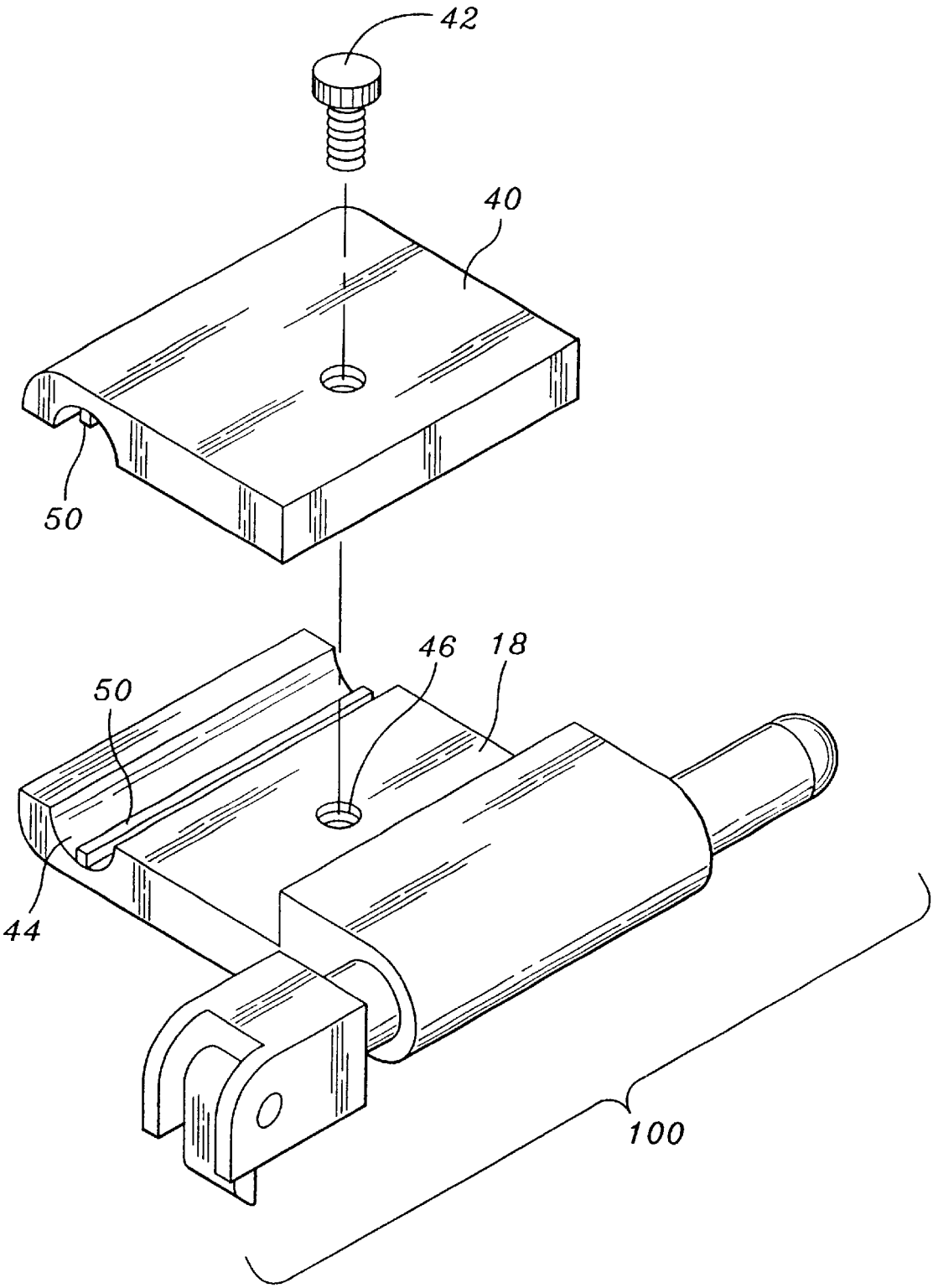
FIG. 4 is an exploded view of the golf training device of the present invention showing the clamping mechanism.

100 of the present invention while mounted on a golf club. Holding block 18 attaches to golf club shaft 13 so that laser 16 is parallel to shaft 13. Positioning of the laser 16 in this orientation affords a compact configuration which can be more easily carried when not in use and which looks less obtrusive when in use. Laser 16 is held away from golf club shaft 13 by about two inches 32 so that laser light 11 is aligned with the center of club head 8 as shown in dimension 34. FIG. 4 shows the attachment means for fastening the training device of the present invention 100 to a golf club. Retaining plate 40 is screwed onto main holding block 18 by a thumb screw 42 which is received by threaded hole 46. Resilient strips 50 act to hold a. golf club shaft securely yet allow the device 100 to be moved up or down of twisted and to remain in place once so positioned. The thumb screw type attachment 42 allows the user to quickly and easily attach or remove the device 100 with out the need for special tools.

Therefore we see that the present invention is a unique and valuable training device which can help a golfer to improve the accuracy of his or her putting activity or full swing activity. The device is easy to install and remove and is easy to calibrate. The device is compact and easy to transport in ones pocket.

Although the above drawings and description of the drawings are a preferred embodiment, it is to be understood that there may be other embodiments of the present invention which fall within the spirit and scope of the claims of the present invention and which would be obvious to one versed in the art of golf training devices.

What is claimed is:

1. A golf training device adapted to be removably mounted onto a shaft of a golf club comprising:

a holding block adapted to be removably secured to the shaft of the golf club;

a light source adapted to be secured to the holding block at a location spaced apart from the shaft of the golf club, said light source being effective to provide a beam of light; and a mirror adapted to be angularly moved relative to said beam of light and positioned relative to said light source to be capable of redirecting said beam of light, and further adapted to be moved to be ineffective to redirect said beam of light.

2. The golf training device of claim 1 wherein said light source is a laser.

3. A golf training device adapted to be removably mounted onto a shaft of a golf club comprising:

a holding block adapted to be removably secured to the shaft of the golf club;

a light source adapted to be secured to the holding block at a location spaced apart from the shaft of the golf club, said light source being effective to provide a beam of light;

a mirror positioned relative to said light source to be capable of redirecting said beam of light; and an elongate alignment strip having a first line substantially perpendicular to the length of said strip and a second line substantially parallel to the length of said strip, and a target having a substantially straight line and being positioned so that said straight line is in substantial alignment with said second line, said light source being positioned so that said beam of light provides a projection on said target.

4. A golf training device adapted to be removably mounted onto a shaft of a golf club comprising:

a holding block adapted to be removably secured to the shaft of the golf club;

a light source adapted to be secured to the holding block at a location spaced apart from the shaft of the golf club, said light source being effective to provide a beam of light; and a mirror secured to said holding block and positioned relative to said light source to be capable of redirecting said beam of light, wherein said mirror is adapted to be moved to be ineffective to redirect said beam of light.

5. The golf training device of claim 4 wherein said mirror is positioned to be ineffective to redirect said beam of light.

6. The golf training device of claim 4 wherein said mirror is positioned to redirect said beam of light in a direction above and substantially parallel to the ground.

7. The golf training device of claim 4 wherein said light source is a laser.

8. The golf training device of claim 4 wherein said light source is a helium neon laser.

* * * * *